United States Patent [19]

Takeda

[11] Patent Number: 5,067,300

[45] Date of Patent: Nov. 26, 1991

[54] METHOD OF ATTACHING CURTAIN WALL UNITS TO A BUILDING SKELETON FRAMEWORK

[75] Inventor: Akihiko Takeda, Tokyo, Japan

[73] Assignee: Yoshida Kogyo K. K., Tokyo, Japan

[21] Appl. No.: 678,804

[22] Filed: Apr. 1, 1991

Related U.S. Application Data

[63] Continuation of Ser. No. 602,510, Oct. 24, 1990, abandoned.

[30] Foreign Application Priority Data

Oct. 24, 1989 [JP] Japan ..... 1-275055

[51] Int. Cl.[5] ..... E04G 21/14; E04C 2/48

[52] U.S. Cl. ..... 52/745; 52/235; 52/506; 52/512

[58] Field of Search ..... 52/235, 391, 397, 475, 52/741, 745, 747, 506, 512

[56] References Cited

U.S. PATENT DOCUMENTS

| | | | |
|---|---|---|---|
| 3,553,918 | 1/1971 | Dawson | 52/235 X |
| 3,742,667 | 7/1973 | Tofani, Jr. | 52/513 X |
| 4,064,664 | 12/1977 | Gaul | 52/235 X |
| 4,423,576 | 1/1984 | Farina et al. | 52/235 |
| 4,522,003 | 11/1985 | Akihama et al. | 52/235 X |
| 4,571,905 | 2/1986 | Kaminaga | 52/506 X |
| 4,662,145 | 5/1987 | Tanikawa et al. | 52/741 X |

FOREIGN PATENT DOCUMENTS

| | | | |
|---|---|---|---|
| 2344429 | 3/1975 | Fed. Rep. of Germany | 52/235 |
| 2364224 | 11/1975 | Fed. Rep. of Germany | 52/235 |
| 1-29942 | 6/1989 | Japan . | |
| 606966 | 5/1978 | U.S.S.R. | 52/235 |
| 2141476 | 12/1984 | United Kingdom . | |
| 2153872 | 8/1985 | United Kingdom | 52/235 |
| 2223043 | 3/1990 | United Kingdom | 52/235 |

*Primary Examiner*—Richard E. Chilcot, Jr.
*Assistant Examiner*—Kien Nguyen
*Attorney, Agent, or Firm*—Hill, Van Santen, Steadman & Simpson

[57] ABSTRACT

A method of attaching curtain wall units to a building skeleton framework wherein a supporting unit of each connector assembly and a lowermost connecting device are secured to the building skeleton framework while they are positioned in all of the so-called "in-face" direction, the so-called "out-of-face" direction and the vertical direction, and a retaining unit of each connector assembly is secured to the upper edge of each curtain wall unit. Thereafter, the retaining unit of a lowermost curtain wall unit is brought into engagement with the corresponding support member, while at the same time, a positioning pin on the lowermost connecting device is fitted with a pin-guide hole in the lowermost curtain wall unit. The lowermost curtain wall unit is then fastened to the building skeleton framework. Subsequently, a pin-guide hole in an upper curtain wall unit is fitted with a positioning pin on the retaining unit of the lowermost curtain wall unit to position the upper curtain wall unit in the in-face and out-of-face directions, while at the same time, the retaining unit of the upper curtain wall unit is brought into engagement with the corresponding supporting unit. Curtain wall units for the succeeding stories are attached to the building skeleton framework successively one above another by repeating the same operation as done with the upper curtain wall unit.

9 Claims, 6 Drawing Sheets

METHOD OF ATTACHING CURTAIN WALL UNITS TO A BUILDING SKELETON FRAMEWORK

This is a continuation of application Ser. No. 602,510 filed Oct. 24, 1990 now abandoned.

BACKGROUND OF THE INVENTION

1. Field of the Invention

The present invention relates to a method of attaching curtain wall units to a building skeleton framework to construct a unit curtain wall.

2. Description of the Prior Art

Unit curtain walls include a plurality of curtain wall units attached to a building skeleton framework in a checkerboard pattern. The curtain wall units thus attached have respective outer surfaces lying flush with each other and they are aligned vertically and horizontally at suitably spaced intervals. In attachment, the curtain wall units are adjusted in position relative to the building framework both in the so-called "in-face" direction (a first horizontal direction parallel to the general plane of the unit curtain wall) and the so-called "out-of-face" direction (a second horizontal direction perpendicular to the general plane of the unit curtain wall).

According to one known method disclosed in Japanese Patent Publication No. 1-29942, for example, the lower edge of a curtain wall unit is positioned in the out-of-face direction relative to the upper edge of a lower curtain wall unit which has previously been attached to a building skeleton framework. Subsequently, the upper curtain wall unit is displaced horizontally right and left and joined with horizontally adjacent two curtain wall units. Finally, the upper curtain wall unit is displaced downward and attached to the building skeleton framework.

The conventional practice is advantageous in that a lower curtain wall unit which has already been attached to the building skeleton frame is utilized as a standard or base when an upper curtain wall unit is attached. This practice however has a drawback that positioning of curtain wall units in the in-face direction and the out-of-face direction is tedious and time-consuming, and hence lowers the construction efficiency of the curtain wall.

SUMMARY OF THE INVENTION

With the foregoing drawbacks in view, it is an object of the present invention to provide a method of attaching curtain wall units to a building skeleton framework work efficiently while positioning them in the so-called "inface" direction (a first horizontal direction parallel to the general plane of a unit curtain wall), the so-called "out-of-face" direction (a second horizontal direction perpendicular to the general plane of the unit curtain wall) and the vertical direction through a simple operation.

In brief, a building-side supporting unit of each of a plurality of connector assemblies and a lowermost connecting device ar positioned relative to, and attached to, a building skeleton framework, while a frame-side retaining unit of each connector assembly is secured to the upper edge of each curtain wall unit. Then, the frame-side retaining unit of a lowermost curtain wall unit is brought into engagement with a corresponding one of the building-side support members, and a positioning pin on the lowermost connecting device is fitted with a pin-guide hole in the lower edge of the lowermost curtain wall unit. While keeping this condition the lowermost curtain wall unit is fastened to the building skeleton framework. Subsequently, a pin-guide hole in the lower edge of an upper curtain wall unit is fitted with a positioning pin on the frame-side retaining unit of the lowermost curtain wall unit to position the upper curtain wall unit both in the in-face direction and in the out-of-face direction, while at the same time, the frame-side retaining unit of the upper curtain wall unit is brought into engagement with, and then fastened to, the corresponding building-side supporting unit. Curtain wall units for the succeeding stories are attached to the building skeleton framework successively one above another by repeating the same operation as done with the upper curtain wall unit.

More specifically, according to the present invention, there is provided a method of attaching curtain wall units to a building skeleton framework, each curtain wall unit including a rectangular frame having at least one oblong pin-guide hole extending longitudinally in a lower edge of the frame, said method comprising the steps of: (a) attaching a lowermost connecting device and a building-side supporting unit of each of a plurality of connector assemblies to the building skeleton framework at vertically spaced intervals while positioning them relative to the building skeleton framework in a first horizontal direction parallel to a vertical plane, in a second horizontal direction perpendicular to the vertical plane, and in a vertical direction, the lowermost connecting device including a first positioning pin extending vertically upwardly and slidably receivable in the pin-guide hole in a lowermost curtain wall unit; (b) preassembling each curtain wall unit with a frame-side retaining unit of each fastener assembly and also with a positioning plate having a pin-guide cutaway groove by attaching the frame-side retaining unit to an upper edge of the frame of the curtain wall unit and temporarily fastening the positioning plate to the lower edge of the frame, with the pin-guide cutaway groove lying across the pin-guide hole, the frame-side retaining unit including a second positioning pin extending vertically upwardly and slidably receivable in the pin-guide hole in an upper curtain wall unit; (c) engaging the pin-guide cutaway groove and the pin-guide hole with the first positioning pin to position the lowermost curtain wall unit in said first and second horizontal directions relative to the building skeleton framework, and at the same time, engaging the frame-side retaining unit on the lowermost curtain wall unit with the building-side supporting unit of a lowermost connector assembly to hang a lowermost curtain wall unit on the building skeleton framework, and subsequently firmly joining the frame-side retaining unit and the building-side supporting unit by at least one screw fastener, thereby attaching the lowermost curtain wall unit to the building skeleton framework; (d) thereafter, engaging the pin-guide cutaway groove and the pin-guide hole in an upper curtain wall unit with the second positioning pin of the lowermost curtain wall unit to position the upper curtain wall unit in the first and second horizontal directions relative to the lowermost curtain wall unit, and at the same time, engaging the frame-side retaining unit of the upper curtain wall unit with the building-side supporting unit of an upper connector assembly to hang the upper curtain wall unit on the building skeleton framework, and subsequently firmly joining the frame-side retaining unit and the building-side supporting unit by at least one screw fastener, thereby attaching the upper curtain wall unit to the building skeleton framework; and (e) subsequently, repeating the preceding step (d), thereby attaching a row of vertically adjacent curtain wall units successively one above another from the bottom to the top of the row of curtain wall units.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 1(*b*) is a side view of FIG. 1(*a*);

FIG. 2(*b*) is a side view of FIG. 2(*b*);

FIG. 3(*b*) is a side view of FIG. 3(*a*);

DETAILED DESCRIPTION

Figure 6:
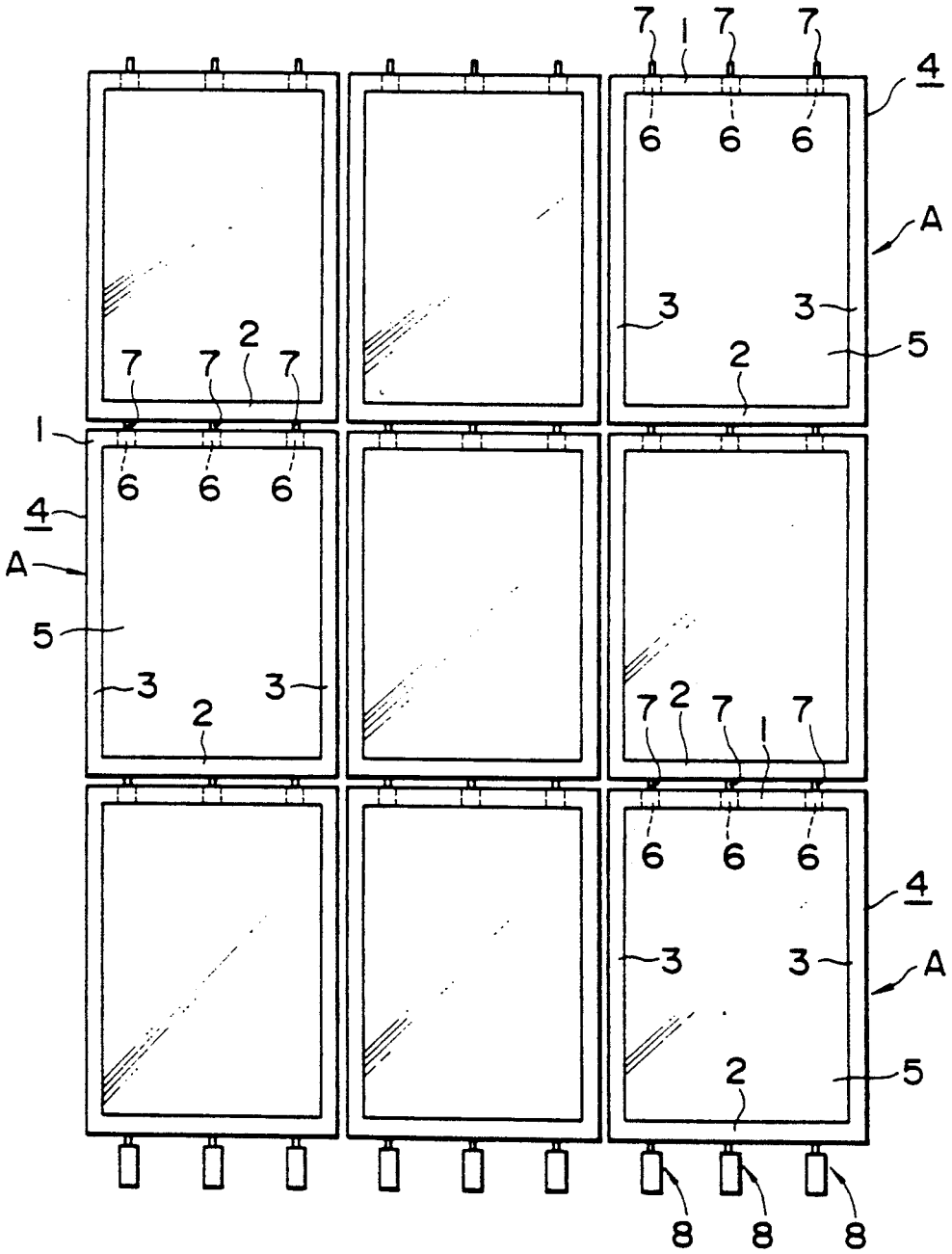
FIG. 6 is a diagrammatical front elevational view of a unit curtain wall including curtain wall units as attached to the building skeleton framework.

As shown in FIG. 6, a unit curtain wall includes a plurality of curtain wall units A arranged in a checkerboard pattern. Each of the curtain wall unit A includes a rectangular frame 4 and a panel 5 mounted within a rectangular opening of the frame 4. The frame 4 comprises a pair of upper and lower horizontal frame members 1, 2 of metal and a pair of vertical side frame members 3, 3 of metal connected to the upper and lower horizontal frame members 1, 2 at their ends. The upper horizontal frame member 1 of each frame 4 is connected to a skeleton framework 9 (FIG. 7) of a building by means of at least one (three in the illustrated embodiment) connector assembly 6. The connector assembly 6 includes an upstanding positioning pin 7 provided on the upper horizontal frame member 1 of the frame 4 of a lower curtain wall unit A and fitted into the lower horizontal frame member 2 of the frame 4 of an upper curtain wall unit A, thereby joining two vertically adjacent curtain wall units A.

The lower horizontal frame member 2 of each of the horizontally juxtaposed lowermost curtain wall units A is connected to the building skeleton framework 9 by at least one (three in the illustrated embodiment) connecting device 8.

Figure 7:
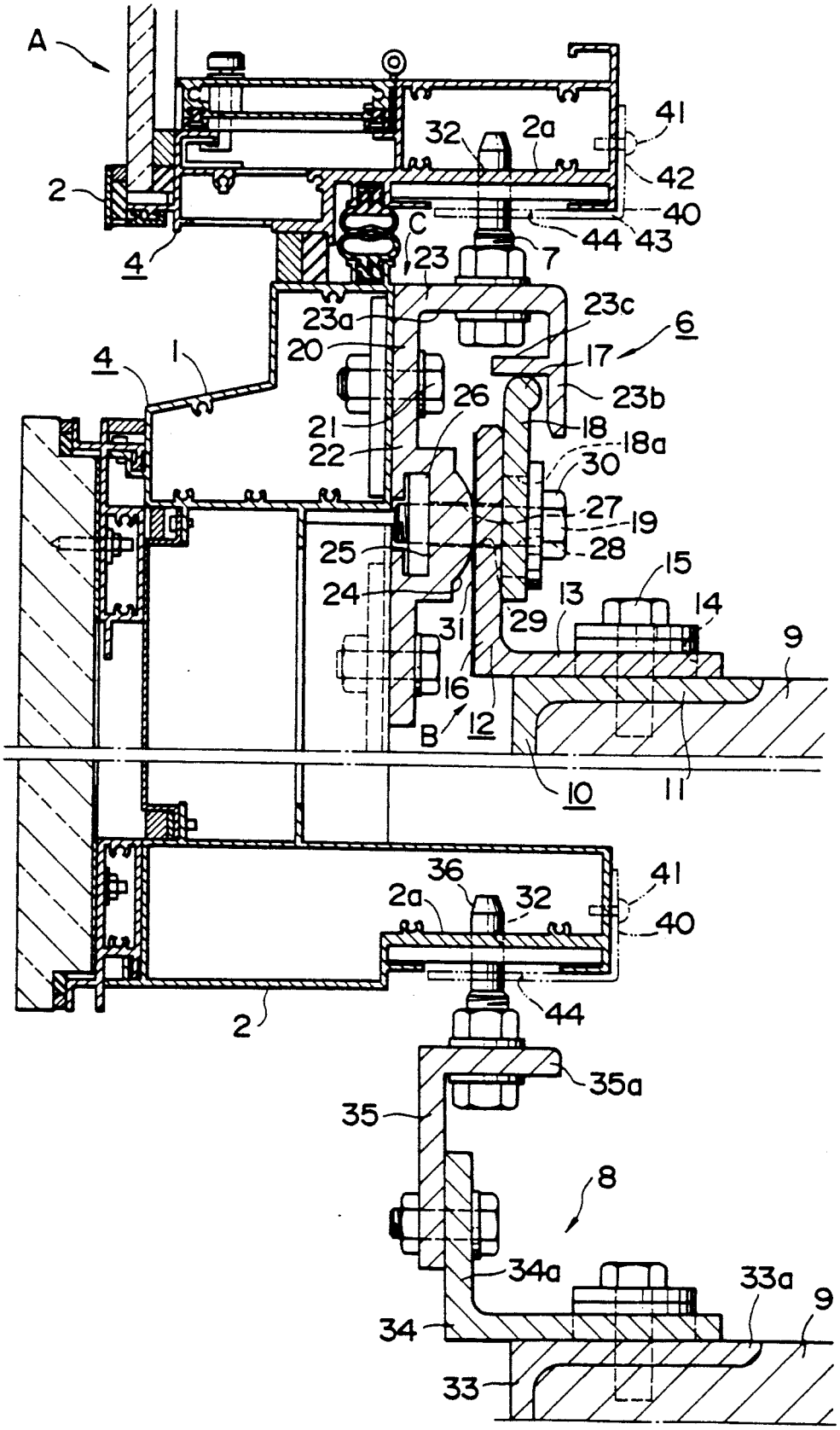
FIG. 7 is a cross-sectional view illustrative of joint structures on opposite vertical ends of a lowermost curtain wall units.

The connector assembly 6, as shown in FIG. 7, is composed of a building-side supporting unit B and a frameside retaining unit C.

The building-side supporting unit B includes a first fastener member 10 of an elongate L-shaped angle embedded in, or fastened to, the building skeleton framework 9, a second fastener member 12 of an elongate L-shaped angle having a horizontal fin 13 fastened to a horizontal fin 11 of the first fastener member 10 by means of screws 15 (one shown) extending loosely through holes 14 (one shown) in the horizontal fin 13, and an elongate height adjustment plate 18 temporarily fastened to a vertical fin 16 of the second fastener member 12 by means of screws (one shown) extending loosely through holes 18*a* (one shown) in the height adjustment plate 18. The height adjustment plate 18 is disposed on an interior side of the vertical fin 16 and has an rounded upper longitudinal edge 17.

The frame-side retaining unit C comprises a generally hook-shaped mounting bracket 20 fastened to an interior vertical wall of the upper horizontal frame member 1 by means of bolt-and-nut fasteners 21 (two shown). The mounting bracket 20 includes a vertical plate member 22 secured to the interior vertical wall of the upper horizontal frame member 1, and a downwardly bent horizontal plate member 23 integra with the vertical plate member 22 and projecting toward the interior of the building. The vertical plate member 22 includes a central projection having an arcuate surface 24 facing toward the interior of the building, an inverted T-shaped horizontal groove 25 non-rotatably receiving therein a nut 26, and a plurality of horizontal holes 27 (one shown) extending perpendicularly to the T-shaped horizontal groove 25 and opening at its opposite ends to the bottom of the T-shaped horizontal groove 25 and the arcuate surface 24. The downwardly bent horizontal plate member 23 includes a horizontal fin 23*a* and a vertical fin 23*b* extending downwardly from an interior edge of the horizontal fin 23*a*. The pins 7 (one shown) are secured to, and extend vertically upwardly from, the horizontal fin 23*a*. The vertical fin 23*b* includes an integral horizontal engagement fin 23*c* projecting toward the vertical plate member 22.

The horizontal engagement fin 23*c* of the vertical plate member 23 slidably engages the rounded upper edge 17 of the height adjustment plate 18. A plurality of bolts (one shown) extend through a plurality of holes 28 in the height adjustment plate 18, through a plurality of holes 29 in the vertical fin 16 of the second fastener member 12, and through the holes 27 in the vertical plate member 22 and they are threaded into the nuts 26 to join or fasten the frame-side retaining unit C and the building-side supporting unit B, with the arcuate surface 24 of the projection urged against an exterior surface of the vertical fin 16 of the second fastener member 12.

The exterior surface of the vertical fin 16 is covered with a low-friction sheet 31 for a purpose described later. The arcuate surface 24 is held in contact with the low-friction sheet 31.

Figure 5:
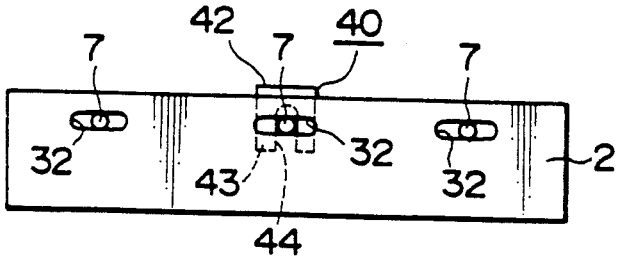
FIG. 5 is an explanatory plan view showing the positional relationship between the positioning plate and pin-guide holes.

The lower horizontal frame member 2 includes a bottom wall 2*a* having three oblong pin-guide holes 32 (one shown) extending longitudinally of the lower horizontal frame member 2. The oblong pin-guide holes 32, as shown in FIG. 5, correspond in position to the position of the positioning pins 7, respectively, and are slidably receptive of the corresponding pins 7 to join the lower edge of an upper curtain wall unit A and the upper edge of a lower curtain wall unit A while positioning them relative to each other in the so-called "out-of-face" direction, i.e. a horizontal direction perpendicular to the general plane of the unit curtain wall.

The lowermost connecting device 8, as shown in FIG. 7, includes a first fastener member 33 of an elongate L-shaped angle embedded in, or fastened to, the building skeleton framework 9, a second fastener member 34 of an L-shaped angle secured to a horizontal fin 33*a* of the first fastener member 33 and adjustable in position relative to the first fastener member 33 in the so-called "in-face" direction, i.e. a horizontal direction parallel to the general plane of the unit curtain wall and also in the out-of-face direction, a third fastener member 35 of an L-shaped angle bolted to a vertical fin 34*a* of the second fastener member 34 and adjustable in position relative to the second fastener member in a vertical direction, and three pins 36 (one shown) secured to, and extending vertically upwardly from, a horizontal fin 35*a* of the third fastener member 35.

The curtain wall units A are attached to the building skeleton framework 9 in the manner described below.

Figure 1A:
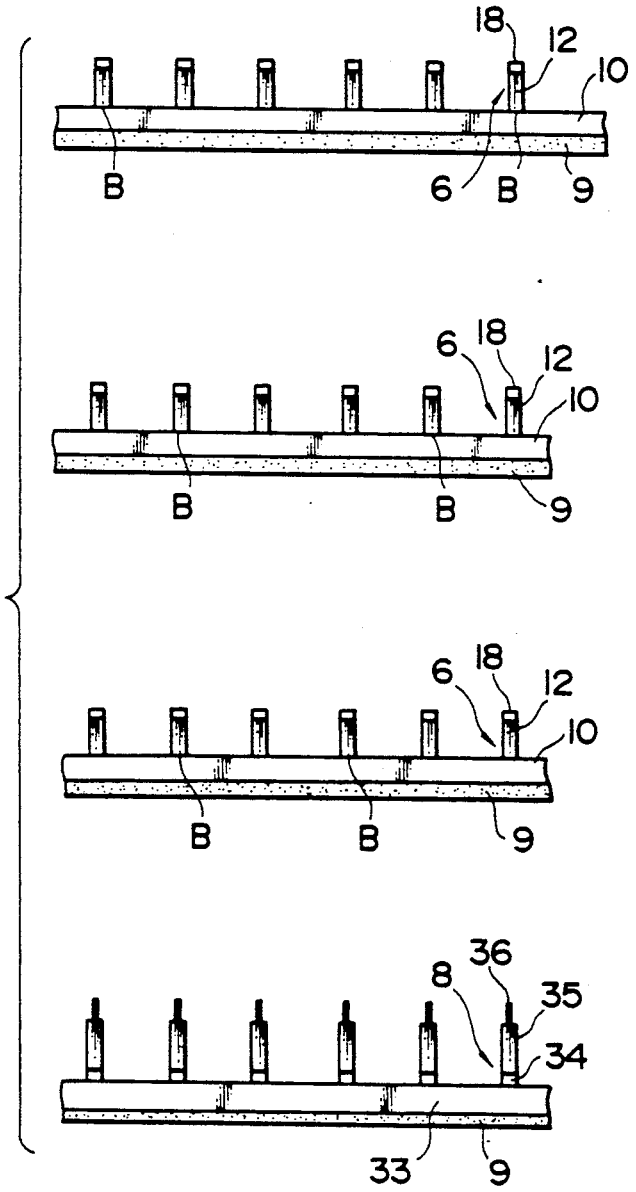
FIG. 1(*a*) is a diagrammatical front elevational view of a skeleton framework of a building to which connector units are attached for installation of curtain wall units.
Figure 1B:
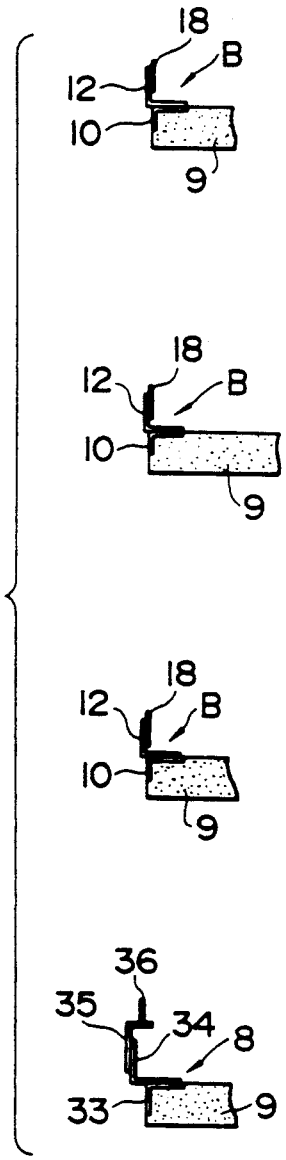

As shown in FIGS. 1(*a*) and 1(*b*), to the building skeleton framework 9 are attached the building-side supporting units B and the lowermost connecting devices 8 while they are positioned in the in-face direction, the out-of-face direction and the vertical direction by using a transit and a leveler (neither shown). More specifically, the second fastener member 12 of each of the building-side supporting unit B is displaced for positioning in the inface direction and the out-of-face direction relative to the first fastener member 10. Subsequently, the height adjustment plate 18 is displaced for positioning in a vertical direction relative to the second fastener member 12. On the other hand, the second fastener member 34 of each of the lowermost connecting devices 8 is displaced for positioning in the in-face-direction and the out-of-face direction relative to the first fastener member 33. Then, the third fastener member 35 is displaced for positioning in a vertical direction relative to the second fastener member 34.

The curtain wall units A which have previously been assembled in a factory or in situ are assembled with the frame-side retaining units C and the positioning plates 40. In this instance, three-frame side retaining units C are positioned and then attached to the upper interior side of the frame 4 of one curtain wall unit A by means of the bolts 21. One positioning plate 40 is temporarily fastened by the screws 41 to a longitudinal central portion of the lower horizontal frame member 2 of the frame 4 of the curtain wall unit A, as indicated by the phantom lines in FIG. 7.

Figure 4:
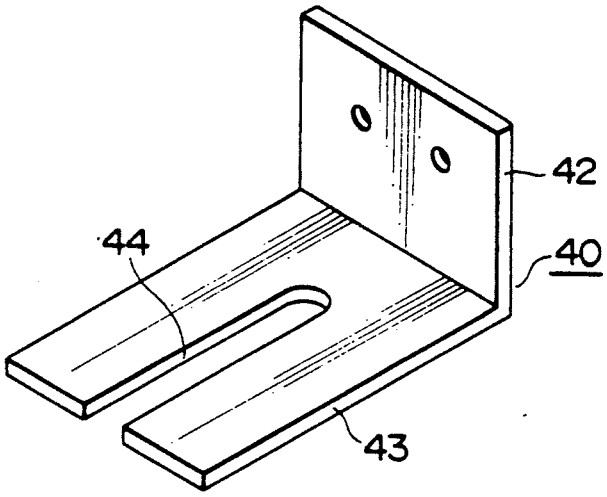
FIG. 4 is a perspective view of an L-shaped positioning plate.

The positioning plate 40, as shown in FIG. 4, has an L shape and includes a vertical member 42 and a horizontal member 43. The horizontal plate member 43 has a transverse pin-guide cutaway groove 44. The vertical plate member 42 has a pair of holes (not designated) through which the screws 41 are threaded to connect the positioning plate 40 to the lower horizontal frame member 2. The pin-guide cutaway groove 44 of the positioning plate 40 thus attached extends transversely across the central oblong pin-guide hole 32 in the lower horizontal frame member 2, as shown in FIG. 5.

Figure 2A:
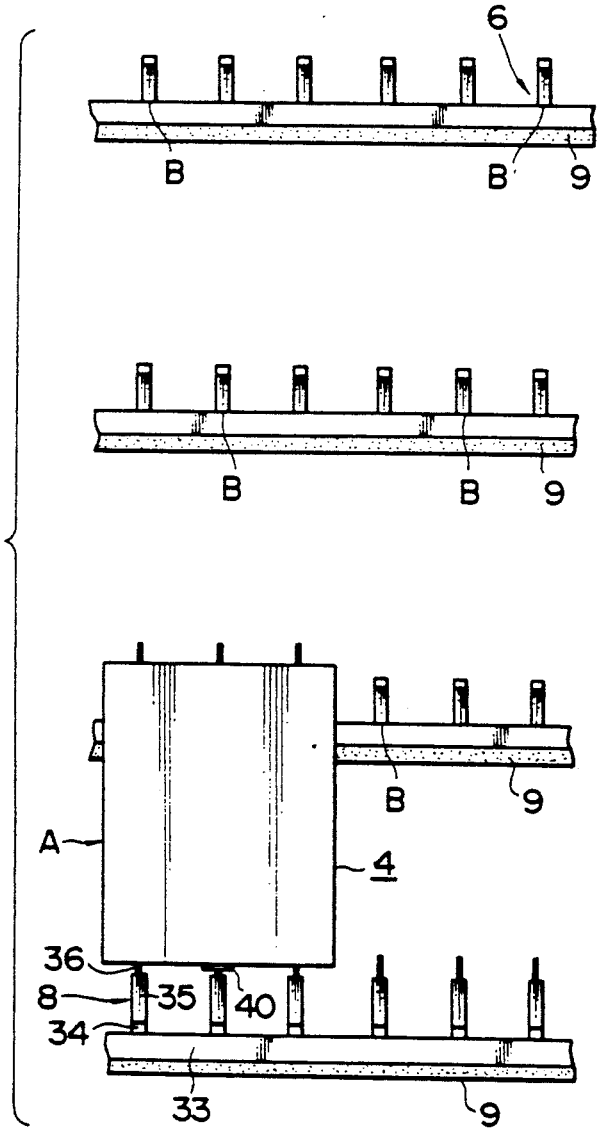
FIG. 2(*a*) is a view similar to FIG. 1(*a*), showing a lowermost curtain wall unit attached to the building skeleton framework.
Figure 2B:
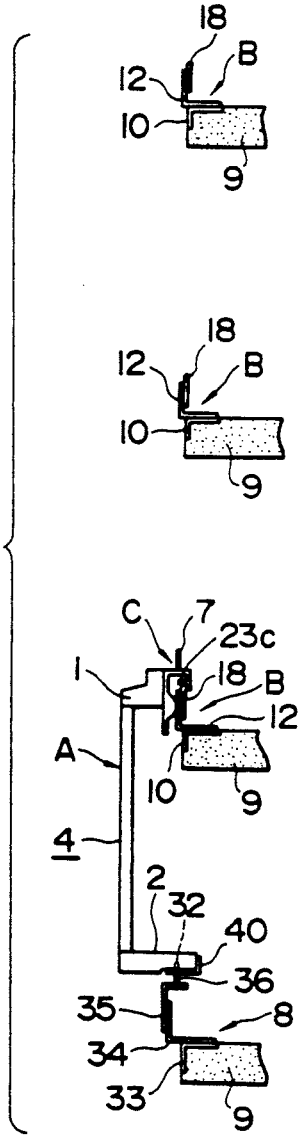

Thereafter, as shown in FIGS. 2(*a*) and 2(*b*), the pin-guide holes 32 in the lower horizontal frame member 2 of a lowermost curtain wall unit A are fitted over the corresponding positioning pins 36 of the lowermost connecting device 8, while at the same time, the respective frame-side retaining units C are hung on the corresponding building-side supporting units B, with the horizontal engagement fins 23*c* held in abutment with the rounded upper edges 17 of the respective height adjustment plates 18. The lowermost curtain wall unit A is thus temporarily joined with the building skeleton framework 9.

In this instance, the lowermost curtain wall unit A is positioned both in the in-face direction and in the out-of-face direction relative to the building skeleton framework 9 by fitting the cutaway groove 44 and the pin-guide holes 32 with the positioning pins 36. This is for the reason that the cutaway groove 44 extends in the out-of-face direction and has a width slidably receptive of the central positioning pin 36, that the oblong pin-guide holes 32 extend in the in-face direction and have a width slidably receptive of the positioning pins 36, and that the cutaway groove 44 lies across the central pin-guide hole 32.

Subsequently, the building-side supporting units B and the frame-side retaining units C are tightly fastened together by the bolts 30 (FIG. 7), whereby the lowermost curtain wall unit A is attached to the building skeleton framework 9.

Then, the positioning plate 40 is detached from the lower horizontal frame member 2, so that the positioning pins 36 are slidably movable along and relative to the oblong pin-guide holes 32, thereby permitting the curtain wall unit A to displace in the in-face direction to cancel out or absorb an inter-layer displacement of the curtain wall unit A. The positioning plate 40 may be detached after all the curtain wall units A are attached to the building skeleton framework 9 together with the positioning plates 40 associated with the respective curtain wall units A.

Figure 3A:
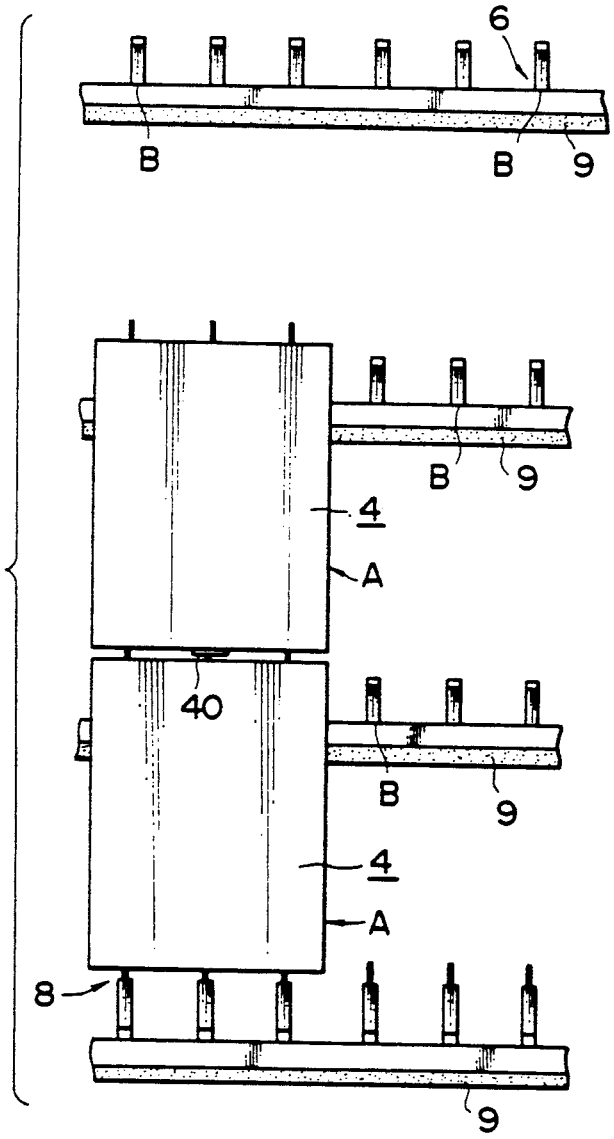
FIG. 3(*a*) is a view similar to FIG. 1(*a*), illustrative of the manner in which a second lowermost curtain wall unit is attached to the building skeleton framework.
Figure 3B:
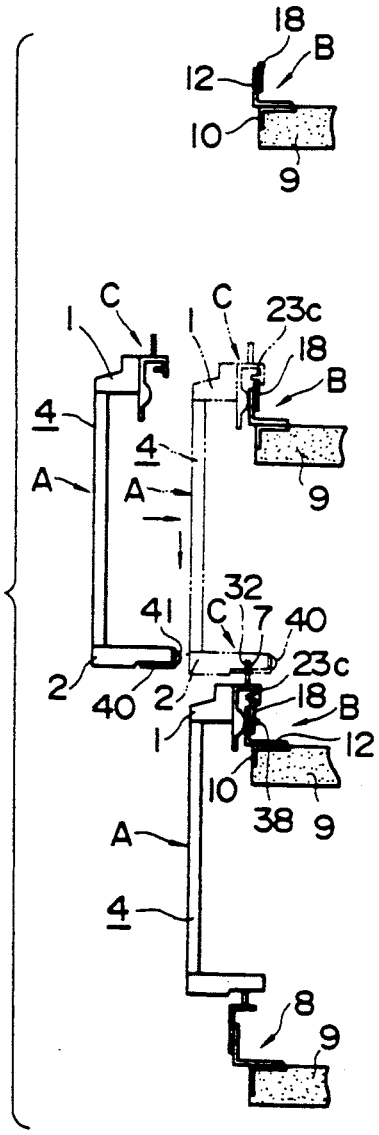

Thereafter, as shown in FIGS. 3(*a*) and 3(*b*), the lower edge (i.e. the lower horizontal frame member 2) of an upper curtain wall unit A is disposed horizontally above the upper edge (i.e. the upper horizontal frame member 1) of the lowermost curtain wall unit A, with the pin-guide holes 32 vertically aligned with the corresponding positioning pins 7. Then, the upper curtain wall unit A is lowered whereupon the pin-guide holes 32 fit over the positioning pins 7 and, at the same time, the frame-side retaining units C hook on the building side supporting units B. During that time, the arcuate surface 24 slides smoothly along the low-friction sheet 31 applied to the vertical fin 16 of the second fastener member 12.

In this instance, since the pin-guide cutaway groove 44 in the horizontal member 43 of the positioning plate 40 lies across the central pin-guide hole 32, as shown in FIG. 5, the central pin 7 is positioned in the in-face direction by the cutaway groove 44. At the same time, the positioning pins 7 are positioned in the out-of-face direction by the pin-guide holes 32. With the positioning pins 7 thus received in the pin-guide holes 32, the lower edge of the upper curtain wall unit A is connected to the upper edge of the previously installed lowermost curtain wall unit A while it is positioned both in the in-face direction and in the out-of-face direction.

Then, the building-side support units B and the frame-side retaining units C are tightly fastened together by the bolts 30, thereby attaching the upper curtain wall unit A to the building skeleton frame 9. Subsequently, the positioning plate 40 is detached from the upper curtain wall unit A.

The curtain wall units A for upper stories are attached to the building skeleton framework 9 successively one above another in the manner as done with the upper curtain wall unit A.

In case of multi-storied buildings, it is possible to proceed the foregoing sequence of attaching operations on the story-by-story basis. In other words, a row of horizontally adjacent curtain wall units of an upper story are attached after all the curtain wall units of a lower story are attached.

As described above, the upper edge of a lowermost curtain wall unit A is joined to a building skeleton framework 9 while it is positioned in the so-called "in-face" direction (a first horizontal direction parallel to the general plane of a unit curtain wall), the so-called "out-of-face" direction (a second horizontal direction perpendicular to the general plane of the unit curtain wall) and a vertical direction. The lower edge of an upper curtain wall unit A is connected with the upper edge of the previously attached curtain wall unit A while it is positioned both in the in-face direction and in the out-of-face direction relative to the upper edge of the previously attached curtain wall unit A. The upper edge of the upper curtain wall unit A is joined to the building skeleton framework 9 while it is positioned in the in-face direction, the out-of-face direction and the vertical direction. The positioning of the curtain wall units can be achieved through a simple operation.

The curtain wall units A can, therefore, be positioned easily in all of the in-face direction, the out-of-face direction and the vertical direction relative to the building skeleton framework 9, and they are joined to the building skeleton framework 9 while keeping such positioned condition.

The positioning plates 40 are removed after the curtain wall units A are attached, so that the positioning pins 7, 36 are movable relatively to and along the oblong pin-guide holes 32 in the in-face direction to take up or absorb an inter-layer displacement of the curtain wall units A.

Obviously, various modifications and variations of the present invention are possible in the light of the above teaching. It is therefore to be understood that within the scope of the appended claims the invention may be practiced otherwise than as specifically described.

What is claimed is:

1. A method of attaching curtain wall units to a building skeleton framework to construct a unit curtain wall, each curtain wall unit including a rectangular frame having at least one oblong pin-guide hole extending longitudinally in a lower edge of the frame, said method comprising the steps of:

(a) attaching a lowermost connecting device and a building-side supporting unit of each of a plurality of connector assemblies to the building skeleton framework at vertically spaced intervals while positioning them relative to the building skeleton framework in a first horizontal direction parallel to a general plane of the unit curtain wall, in a second horizontal direction perpendicular to the general plane of the unit curtain wall, and in a vertical direction, the lowermost connecting device including a first positioning pin extending vertically upwardly and slidably receivable in the pin-guide hole in a lowermost curtain wall unit;

(b) preassembling each curtain wall unit with a frame-side retaining unit of each fastener assembly and also with a positioning plate having a pin-guide cutaway groove by attaching the frame-side retaining unit to an upper edge of the frame of the curtain wall unit and temporarily fastening the positioning plate to the lower edge of the frame, with the pin-guide cutaway groove lying across the pin-guide hole, the frame-side retaining unit including a second positioning pin extending vertically upwardly and slidably receivable in the pin-guide hole in an upper curtain wall unit;

(c) engaging the pin-guide cutaway groove and the pin-guide hole with the first positioning pin to position the lowermost curtain wall unit in said first and second horizontal directions relative to the building skeleton framework, and at the same time, engaging the frame-side retaining unit on the lowermost curtain wall unit with the building-side supporting unit of a lowermost connector assembly to hang a lowermost curtain wall unit on the building skeleton framework, and subsequently firmly joining the frame-side retaining unit and the building-side supporting unit by at least one screw fastener, thereby attaching the lowermost curtain wall unit to the building skeleton framework;

(d) thereafter, engaging the pin-guide cutaway groove and the pin-guide hole in an upper curtain wall unit with the second positioning pin of the lowermost curtain wall unit to position the upper curtain wall unit in the first and second horizontal directions relative to the lowermost curtain wall unit, and at the same time, engaging the frame-side retaining unit of the upper curtain wall unit with the building-side supporting unit of an upper connector assembly to hang the upper curtain wall unit on the building skeleton framework, and subsequently firmly joining the frame-side retaining unit and the building-side supporting unit by at least one screw fastener, thereby attaching the upper curtain wall unit to the building skeleton framework; and (e) subsequently, repeating the preceding step (d), thereby attaching a row of vertically adjacent curtain wall units successively one above another from the bottom to the top of the row of curtain wall units.

2. A method according to claim 1, between the steps (c) and (d), further including removing the positioning plate from the lowermost curtain wall unit, and also between the steps (d) and (e), further including removing the positioning plate from the upper curtain wall unit.

3. A method according to claim 1, after the step (e), further including removing the positioning plate from each of the curtain wall units.

4. A method according to claim 1, wherein said lowermost connecting device includes an L-shaped first fastener member for being fastened to the building skeleton framework and having a horizontal fin, an L-shaped second fastener member secured to said horizontal fin of said first fastener member and having a vertical fin, and an L-shaped third fastener member secured to said vertical fin of said second fastener member and a horizontal fin, said second fastener member being adjustable in position relative to said first fastener member in said first and second horizontal directions, said third fastener member adjustable in position relative to said second fastener member in the vertical direction, said first positioning pin being secured to said horizontal fin of said third fastener member.

5. A method according to claim 1, wherein said building-side supporting unit includes an L-shaped first fastener member for being fastened to the building skeleton framework and having a horizontal fin, an L-shaped second fastener member secured to said horizontal fin of said first fastener member and having a vertical fin, and a height adjustment plate temporarily connected to said vertical fin of said second frame member, said second fastener member being adjustable in position relative to said first fastener member in said first and second horizontal directions, said height adjustment plate being adjustable in position relative to said second fastener member in the vertical direction, said frame-side retaining unit comprising a hook-shaped bracket including a vertical plate member for being secured to the frame and a downwardly bent horizontal plate member integral with said vertical plate member, said horizontal plate member having a horizontal engagement fin slidably engageable with an upper longitudinal edge of said height adjustment plate, said second positioning pin being secured to said horizontal plate member, each said screw fastener extending successively through said height adjustment plate, said vertical fin of said second fastener member and said vertical plate member.

6. A method according to claim 5, wherein said upper longitudinal edge of said height adjustment plate is rounded.

7. A method according to claim 5, wherein said vertical plate member of said hook-shaped bracket includes a projection facing toward the interior of a building and having a T-shaped horizontal groove non-rotatably receiving therein a nut for being threaded with said screw fastener.

8. A method according to claim 5, wherein said height adjustment plate is disposed on an interior side of said vertical fin of said second frame member, said vertical plate member including an arcuate surface facing toward the interior of a building and slidably engageable with an exterior surface of said vertical fin.

9. A method according to claim 8, wherein said exterior surface of said vertical fin is covered with a low-friction sheet.

* * * * *